US009511838B2

(12) United States Patent
Mondino et al.

(10) Patent No.: US 9,511,838 B2
(45) Date of Patent: Dec. 6, 2016

(54) BOAT PROPULSION DEVICE

(71) Applicants: Juan José Mondino, Sante Fe (AR); Alberto Luis Groppelli, Alicante (ES)

(72) Inventors: Juan José Mondino, Sante Fe (AR); Alberto Luis Groppelli, Alicante (ES)

( * ) Notice: Subject to any disclaimer, the term of this patent is extended or adjusted under 35 U.S.C. 154(b) by 0 days.

(21) Appl. No.: 14/921,234

(22) Filed: Oct. 23, 2015

(65) Prior Publication Data

US 2016/0059948 A1 Mar. 3, 2016

Related U.S. Application Data

(63) Continuation of application No. PCT/ES2014/070342, filed on Apr. 22, 2014.

(30) Foreign Application Priority Data

Apr. 25, 2013 (AR) ..... P20130101385

(51) Int. Cl.

| | |
|---|---|
| ***B63H 20/08*** | (2006.01) |
| ***B63H 20/00*** | (2006.01) |
| ***B63H 20/06*** | (2006.01) |
| ***B63H 20/22*** | (2006.01) |
| ***B63H 20/34*** | (2006.01) |
| ***B63H 20/10*** | (2006.01) |
| ***B63H 20/12*** | (2006.01) |

(52) U.S. Cl.

CPC ..... *B63H 20/007* (2013.01); *B63H 20/06* (2013.01); *B63H 20/08* (2013.01); *B63H 20/10* (2013.01); *B63H 20/12* (2013.01); *B63H 20/22* (2013.01); *B63H 20/34* (2013.01)

(58) Field of Classification Search

CPC ..... B63H 20/00; B63H 20/08; B63H 20/10; B63H 20/06; B63H 20/007; B63H 20/12; B63H 20/22; B63H 20/34

USPC ..... 440/53, 55, 63, 65

See application file for complete search history.

(56) References Cited

U.S. PATENT DOCUMENTS

| | | | |
|---|---|---|---|
| 827,202 | A | 7/1906 | Bachman |
| 1,316,169 | A | 9/1919 | Liberty |
| 1,479,025 | A | 1/1924 | Caille et al. |
| 1,586,517 | A | 6/1926 | Caille et al. |
| 1,831,739 | A | 11/1931 | Decker |

(Continued)

FOREIGN PATENT DOCUMENTS

| | | |
|---|---|---|
| AR | 068218 | 11/2009 |
| WO | WO 2014/174137 A1 | 10/2014 |

*Primary Examiner* — Lars A Olson

(74) *Attorney, Agent, or Firm* — Hess Patent Law Firm; Robert J. Hess

(57) ABSTRACT

A detachable boat propulsion device (1), comprising a clamp (2) adjustable to the boat; a type T hinge (3) on said clamp, which allows free rotation around a vertical angle (4) and a horizontal angle (5); a platform (6) tied: to a command handle (7), to the transmission (8), to a motor (9), to said type T hinge; wherein said transmission comprises a shaft (81), a shaft holder (82), a flap (83), at least one deflector of foreign objects (84) and a propeller (85); characterized by comprising a flexible elongated element(10), which is tied at one end (101) to said type T hinge and at the other end is hooked to a fixation device (61); wherein said fixation device is tied to said platform (6), and wherein said flexible elongated element limits freedom of rotation, when tensed, in said vertical inclination angle (4).

10 Claims, 6 Drawing Sheets

(56) References Cited

U.S. PATENT DOCUMENTS

| | | | | |
|---|---|---|---|---|
| 1,953,599 | A | 4/1934 | Grimes | |
| 2,513,050 | A | 6/1950 | Pugh | |
| 2,713,843 | A | 7/1955 | Staley | |
| 2,996,035 | A * | 8/1961 | Torrey | B63H 20/10 440/53 |
| 3,498,253 | A | 3/1970 | Wood | |
| 4,604,067 | A | 8/1986 | Roberts | |
| 4,676,756 | A | 6/1987 | Rodrigue et al. | |
| 4,678,440 | A | 7/1987 | Rodrigue | |
| 4,976,637 | A | 12/1990 | Newell et al. | |
| 5,413,511 | A | 5/1995 | Hawkenson | |
| 5,931,710 | A | 8/1999 | Johnson, Sr. | |
| 6,616,489 | B1 | 9/2003 | Dompierre et al. | |
| 7,048,600 | B1 | 5/2006 | Broussard | |
| 2001/0031586 | A1 | 10/2001 | Fisher | |
| 2012/0214366 | A1 | 8/2012 | Uhlenhopp | |

* cited by examiner

BOAT PROPULSION DEVICE

FIELD OF THE INVENTION

The present invention relates to propellers of small outboard motorboats. In particular, it is related to propellers, which are useful for any water surface, more particularly for shallow waters and in the presence of aquatic vegetation as well as flexible or moving obstacles.

STATE OF THE ART

There are numerous solutions developed to navigate shallow waters such as shallow rivers, swamps, marshes, lakes, etc. Outboard motors and airboats as well as power-driven propelling installations or boat propulsion devices are the most common ones.

In relation to outboard propellers featuring an inclined drive shaft, known as boat propulsion devices, some patent documents have been detected and are presented hereby as background to the present invention. Among them: U.S. Pat. Nos. 1,831,739, 1,316,169, 2,513,050, 827,202, 1,479,025, 1,586,517, 1,953,599, 3,498,253, 6,616,489, 5,413,511, 4,976,637, 4,678,440, 4,604,067, 4,676,756, US2012214366 and AR068218, being the latter a document belonging to the same inventor in this application.

Numerous technical problems are not solved in the state of the art referred to. In particular, it has been detected that the use of the existing models on the market causes the helmsman or the user of said boat propulsion devices undesired effects after a short time of operation, such as tiredness, cramps, etc. In brief, it has been observed that handling said boat propulsion devices is uncomfortable. After a thorough study, the inventors of the present invention detected that the source of discomfort for the helmsman arises from several origins:

a) The boat propulsion devices existing up to date are "held" by the helmsman. Usually, the motor is placed in such a position that a balance is reached at moments of forces regarding the supporting point of the detachable boat propulsion device, on a test bench outside the water body, which allows holding the device effortlessly. However, the boat propulsion device in operation shows other moments of force that cannot be taken into account on their dry balancing, such as the pressure exerted by the flap, the thrust of the propeller, the force of the water, water hyacinths or aquatic plants that become entangled, objects touched due to shallowness, etc. Any imbalance of moments must be absorbed, up to date, by the helmsman.

b) The existing boat propulsion devices require a constant correction, on the part of the helmsman, to keep the propeller submerged to the same depth. The depth of the propeller determines the effective power delivered by the detachable boat propulsion device for the boat to run. This forces the helmsman to be constantly correcting the vertical inclination of the detachable boat propulsion device, mainly steering a change of direction, when it is necessary to turn at a horizontal angle regarding the detachable boat propulsion device.

c) On turning, the propeller not only pushes the water backwards regarding the boat, but also generates a torque which, depending of the direction in which the helix turns, draws the boat propulsion device to the sides.

d) In this type of boat propulsion device, the drive shaft is of a considerable length. Therefore, flexion is generated in said shaft and this transfers vibrations along the supporting body; said vibrations reach the helmsman through the command handle.

The present invention solves these technical problems, achieving as a result a detachable boat propulsion device which is comfortably maneuvered, as it has never been reported before in the state of the art.

Comfortable handling of the detachable boat propulsion device of the present invention results mainly from its innovative system of limiting the vertical inclination angle which allows the helmsman not having to correct moments exerted in that sense under operation. A flexible elongated element which, in a preferred embodiment of the invention is a chain, allows the helmsman to regulate the depth of the propeller, according to the length given to said element, and also to hold it effortlessly when running.

Also, the present invention comprises a flap on the propeller, the trailing edge of which is placed at an angle of between 1° and 10° sexagesimals regarding the horizontal axis. This compensates the torque generated by the helix and avoids lateral traction caused by the detachable boat propulsion device.

Finally, the long drive shaft is separated from the shaft holder by at least two spacer bushings that materially improve the harmonious balancing generated due to the flexibility of said shaft, thus eliminating annoying vibrations caused by the drive shaft.

BRIEF DESCRIPTION OF THE DRAWINGS

To make it more intelligible, the object of this invention has been illustrated with schematic drawings in its preferred embodiment, with the sole purpose of serving as examples. Said drawings are by no means aimed at limiting the protection spectrum defined in the claims herein. As well as the following brief and detailed descriptions, the figures herein shall be considered examples of applications of the present invention for explanatory purposes, for a better understanding of said invention, without restricting the protection spectrum:

BRIEF DESCRIPTION OF THE INVENTION

Figure 1A:
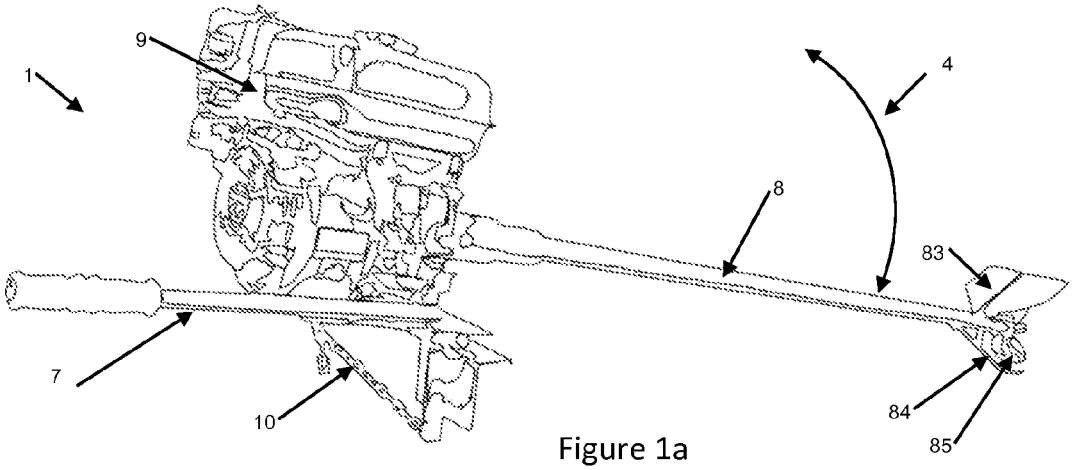
FIG. 1*a*: Perspective view of the detachable boat propulsion device of the present invention assembled to a motor.

The detachable boat propulsion device for driving boats (1) which is the object of this invention, comprises a clamp (2) adjustable to the boat; a type T hinge on said clamp (3), which allows free rotation in a vertical angle of inclination (4) and on a horizontal rotational angle (5); a platform (6) tied securely: to a command handle (7), to the transmission (8), to a motor (9) and to said type T hinge; wherein said transmission comprises a shaft (81), a shaft holder (82), a flap (83), at least one deflector of foreign objects (84) and a propeller (85); characterized by comprising a flexible elongated element (10), which is tied at one end (101) to said type T hinge and at the other end is hooked to a fixation device (61); wherein said fixation device is tied to said platform (6), and wherein said flexible elongated element limits freedom of rotation, when tensed, in said vertical inclination angle (4).

Wherein said type T hinge (3), in a preferred embodiment, comprises at its lower end a device (31) that rotates freely around its vertical axis and is securely attached to one of the ends (101) of said flexible elongated element (10).

In addition, in a preferred embodiment said platform (6) comprises a transmission sector (62) on which said transmission (above) and said type T hinge (below) are attached; and a command sector (63) to which said command handle reaches, and on which said fixation device (61) is securely attached.

In a preferred embodiment of the present invention said flexible elongated element may be attached to said fixation device in more than one position, allowing the user to vary the length (103) of said flexible elongated element which is subject to traction and therefore to regulate said vertical inclination angle (4).

In a preferred embodiment of the present invention said flexible elongated element is a chain and said fixation device is a hook which allows hooking any link of the chain. In addition, this system may be constituted by a ribbon with buttonholes, a wire with loops, a velcro ribbon and velcro as a fixation device, among many other alternatives.

In another preferred embodiment of the present invention, said flap (83) comprises a trailing edge (831) with an angle regarding the horizontal axis (832) of between 1 and 10° sexagesimals, preferably between 1 and 5° sexagesimals, more preferably between 2 and 4° sexagesimals.

In an embodiment of the present invention, said transmission, between said shaft (81) and said shaft holder (82), comprises at least two bushings (86) which absorb and avoid shaft vibrations.

In a preferred embodiment, the present invention is detachable and comprises said command handle (7) which is removable and may be affixed with screws (71) to said holder; and said transmission (8), which is removable, and attached to said holder by at least two set screws (815 and 816).

DETAILED DESCRIPTION OF THE INVENTION AND EXAMPLE

The parts comprising the detachable boat propulsion device (1), object of the present invention, are described as follows, according to a preferred embodiment, that is given as an example non limitative with regard to the claims attached.

In a preferred embodiment of the invention, said clamp (2) can be an inverted U-shaped metal plate (21), so that said U-shaped metal plate is inserted into the boat transom. This clamp has fixation means (22) which can be nuts welded to said inverted U by which respective screws (23) holding said transom are tightened. In turn, said clamp is securely attached, preferably welded (24) to the main vertical body of said type T hinge which is to support the detachable boat propulsion device.

Said type T hinge (3) is a hinge comprising a hollow tube shaped as a T (32). The upper part of the T (33) carries a movable horizontal axis (34) whose ends are inserted into corresponding cylinders (35) welded to a platform (6). This enables the platform (6) to rotate freely in a vertical angle, upwards and downwards, while a vertical shaft (36) inserted into the main body of the T allows the T securely attached to said holder to rotate in a horizontal angle. Also, said vertical shaft is incorporated into a device (31) that, in a preferred embodiment is a cylinder that rotates freely on said vertical shaft at the lower part of the T. Seguer-type locks can prevent these shafts from coming out of their housings as described.

All type T hinge movements have mechanized calibrated Teflon bushings in its preferred embodiment, so as to avoid metal friction and eliminate vibration noise.

Said platform (6) is an element supporting the motor and it is attached to the type T hinge (3), to the transmission (8) and the command handle (7). In a preferred embodiment, said platform is a metal plate base with holes to attach the command handle by means of screws. It contains a fixation device which can be a welded hook (61) at the command sector. It also comprises another metal plate (64) perpendicular to the first one, with holes to fasten the motor with screws on one side and a cylinder (65), preferably welded to said perpendicular metal plate (64) on the other side, to attach the transmission shaft holder.

A transmission sector (62) is defined. It is the rear part of the platform, next to the transmission, i.e., on the side of the water where the propeller is submerged. And a command sector (63), which is the front part of the platform, on the side of the helmsman when the detachable boat propulsion device pushes the boat.

The transmission (8) comprises a shaft (81), a shaft holder (82), a flap (83), at least a deflector of foreign objects (84) and a propeller (85).

Said shaft, in a preferred embodiment is a solid steel cylinder with means to be attached on one end (811) to the propeller and on the other end (812) to the motor shaft. As it can be seen in FIG. 4 said motor shaft is attached by means of a coupling element (813) which in turn is attached to the shaft by a pin (814), and this coupling element is in turn attached to the motor shaft by means of a set screw (815) tightened externally. This coupling is in turn inserted in said cylinder (65).

On the other hand, the cylinder (65), which in the preferred embodiment seen in the Figures can have two diameters, is attached to the shaft holder by means of a set screw or a nut to lock the shaft holder (816). These two set screws 815 and 816 allow a fast disassembling of the detachable boat propulsion device of the present invention. This provides a technical effect which is not known in the state of the art, since the command handle and the whole set is easy to detach, allowing the disassembly of the present invention promptly and in a few steps, thus rendering this invention a device which is easily carried in the trunk of a standard vehicle.

Also, the shaft is linked to the shaft holder by means of two bearings: a conical bearing (817) positioned at the end corresponding to the propeller and a cylindrical bearing (818) located on the side of the motor. Said cylindrical bearing is attached to the shaft by means of a spring (819) which allows sealing hermetically the space between the shaft and the shaft holder. At least one double-lip seal (820) located next to the conical ball bearing contributes to airtightness. This system of attaching the shaft on the shaft holder enables said spring to keep enough pressure on said ball bearing. This simple but original solution for this technological field enables the transmission of the present invention to be light, safe and air-tight, operating full of oil without the risk of leaks.

Another inventive aspect of the present invention is the fact that it comprises at least two bushings (86) which prevent and absorb shaft vibrations occurring between said shaft (81) and said shaft holder (82) of the transmission. Said bushings eliminate the vibration originated by the rotation of the long shaft when generating harmonics which were very annoying for the helmsman. Preferably these cylindrical bushings are made of Teflon.

The boat propulsion device of the present invention has the ability to admit any motor suitable for the purpose. Four-stroke engines are preferred for being non-pollutant. They can be of different brands such as Yamaha, Honda, Villa, etc.

The flexible elongated element (10) of the present invention is securely attached at one of its ends (101) to said type T hinge, and attached to said fixation device (61), which in turn is securely attached to said platform (6).

This flexible elongated element of the invention can be positioned in such a manner that its effective length is variable, which allows regulating the depth of the propeller since it defines the operation angle of the vertical inclination. Also, the fact of being attached on its lower end to said movable cylinder (31) to rotate freely, presents as a technical effect that the depth of the propeller can be the same for any horizontal angle of operation. This technical effect is absolutely innovative for this technological field, since the helmsman, without any effort, can maneuver turns with the same power aimed at propelling the boat since the depth of the propeller remains constant. This constant depth is also understood since said flap in operation, when the boat moves forward, exerts a downward force that pushes the command handle upward. At this moment the effective length of the flexible elongated element is tensed and thus the freedom of rotation in said vertical inclination angle becomes limited.

Said flexible elongated element may be any flexible element of a longitudinal dimension greater than its other dimensions, such as a chain, thread, cord, wire, cable, long piece of fabric, etc. In a preferred embodiment, it is a chain attached to said device which is a hook welded at any of its links.

Said chain allows regulating the vertical inclination angle of the detachable boat propulsion device of the invention. Another innovative technical effect is that this invention allows positioning said chain so that the propeller remains outside the water, for example in a horizontal position of the axis and thus it is possible to use the motor as a power generator. This effect is utterly useful for activities in the littoral areas and in regions away from conventional power supply distribution.

In a preferred embodiment of the present invention, said flap (83) is a welded metal plate of a triangular shape, attached to the shaft holder at one of its vertices, and comprises a trailing edge (831) which is the opposite side of said vertex, at an angle (832) regarding the horizontal axis of between 1 and 10° sexagesimals, preferably between 1 and 5° sexagesimals, more preferably between 2 and 4° sexagesimals. This angle, from a rear view of the boat, is negative if the propeller turns anticlockwise, and it is positive if the propeller turns clockwise.

In a preferred embodiment, the present invention is detachable or disassembled and comprises said command handle (7) which is removable and can be fixed with screws (71) to said holder; said transmission (8) which is removable and attached to said holder by means of two set screws (815 and 816).

GLOSSARY

The present document assigns a specific meaning to each of the following expressions:

Detachable boat propulsion device: It hereby refers to a propelling device for boats, the motor drive shaft of which is the propelling shaft and it is elongated, being submerged into water at a certain angle of between 50° and 5° sexagesimals regarding the horizontal axis. The fact of being detachable means that it can be removed from any boat. It is not assembled permanently. This definition does not include the propelling devices usually known as "outboard", which are driven by a complex transmission which allows the propeller to operate on a horizontal axis.

Flexible elongated element can be any flexible element of a longitudinal dimension greater than its other dimensions, such as a chain, thread, cord, wire, cable, long piece of fabric, etc.

Fixation device is a device allowing the attachment of said flexible elongated element at several points along its extension. For example, a hook is enough for a chain. It can be a velcro system, a hook to tie a cord or wire, etc.

Figure 1B:
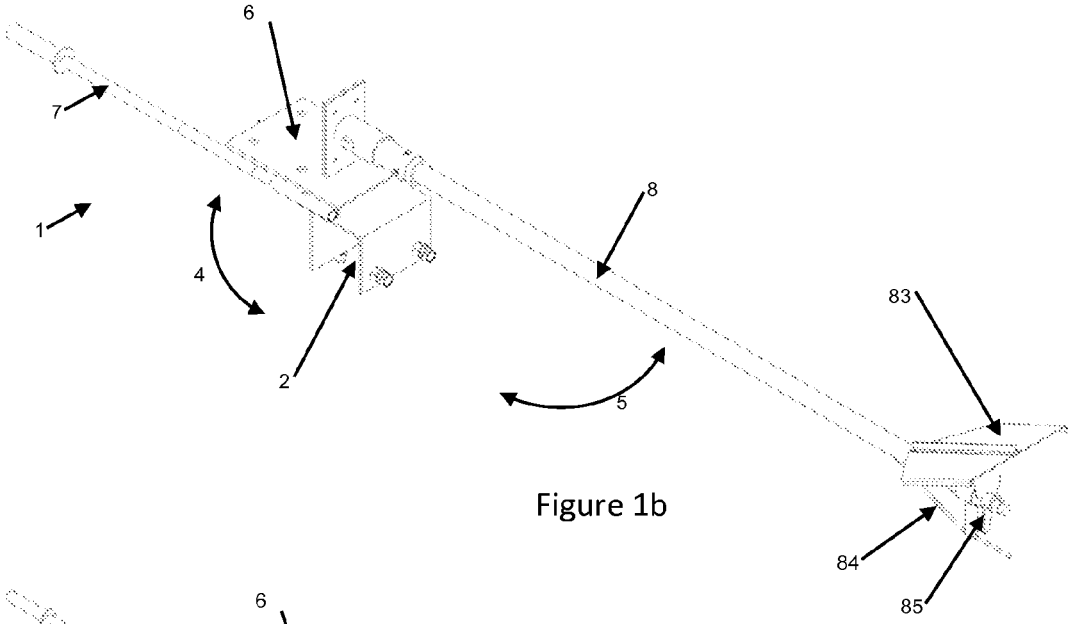
FIG. 1*b*: Perspective view of the basic elements of the detachable boat propulsion device of the invention.
Figure 1C:
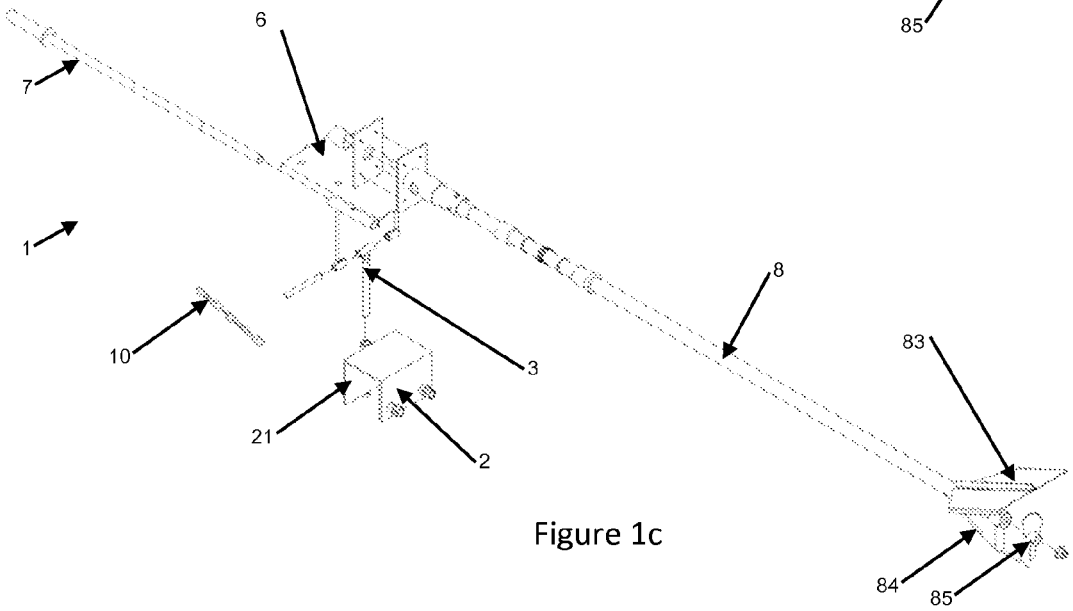
FIG. 1*c*: Perspective view of the basic elements of the detachable boat propulsion device of the invention, dissassembled.
Figure 2:
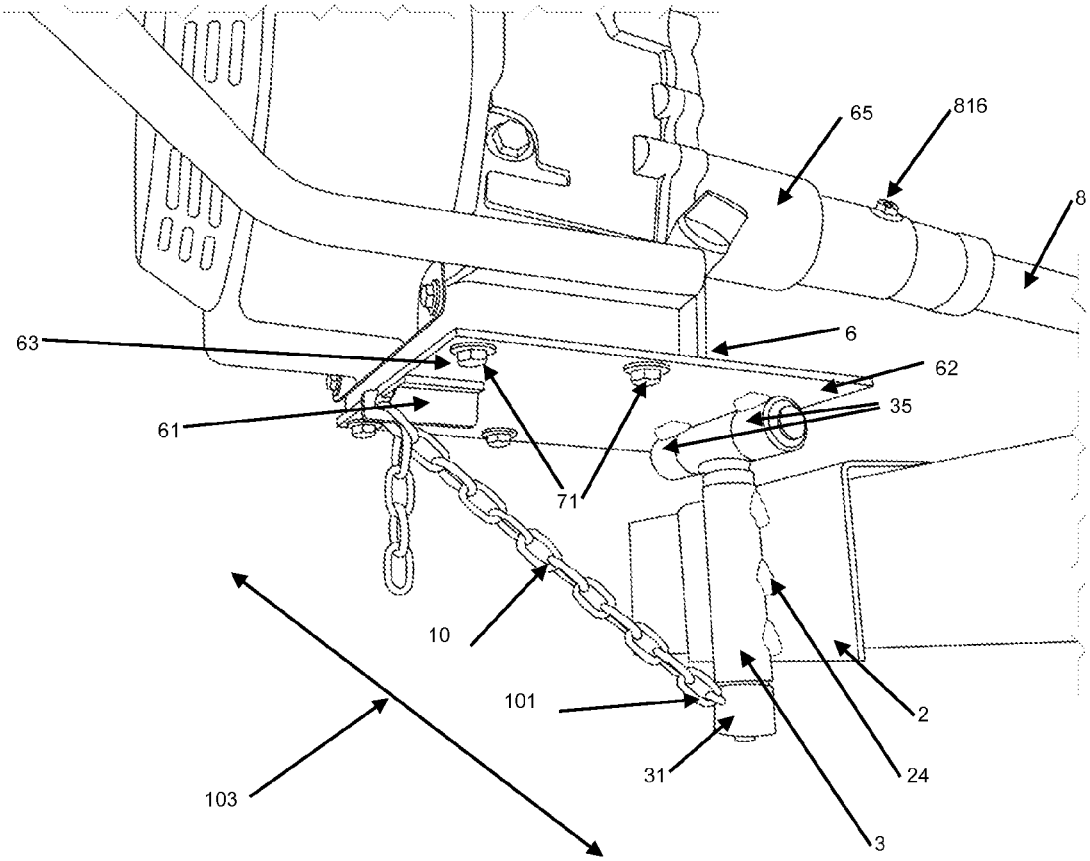
FIG. 2: Detail in perspective of the set of type T hinge, flexible elongated element and platform, in operation.
Figure 3B:
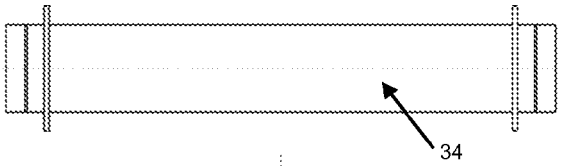
FIG. 3*b* a side view of a movable horizontal axis inserted into upper part of the T hinge.
Figure 3C:
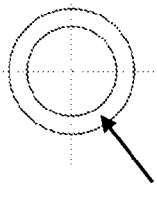
FIG. 3*c* frontal projection view of upper part of T hinge.
Figure 3A:
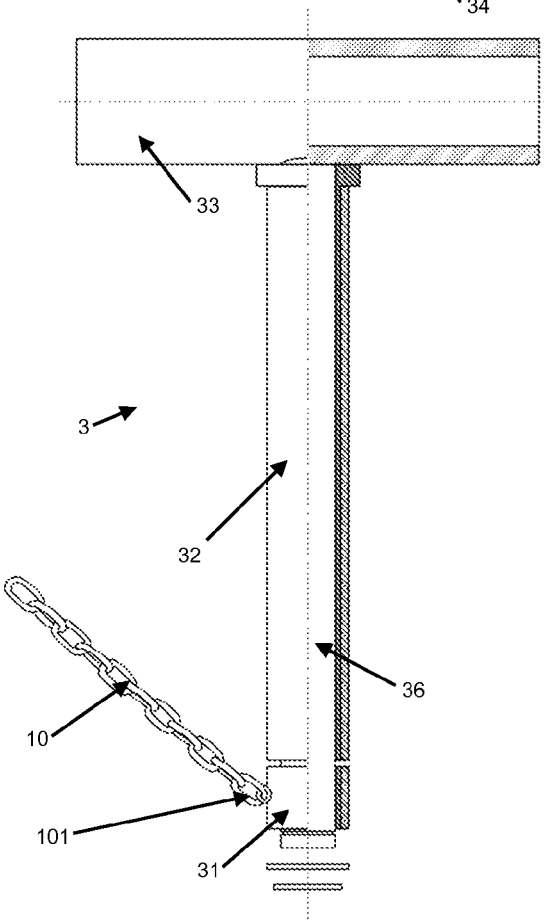
FIG. 3*a*: Detail of the type T hinge of the present invention.
Figure 3D:
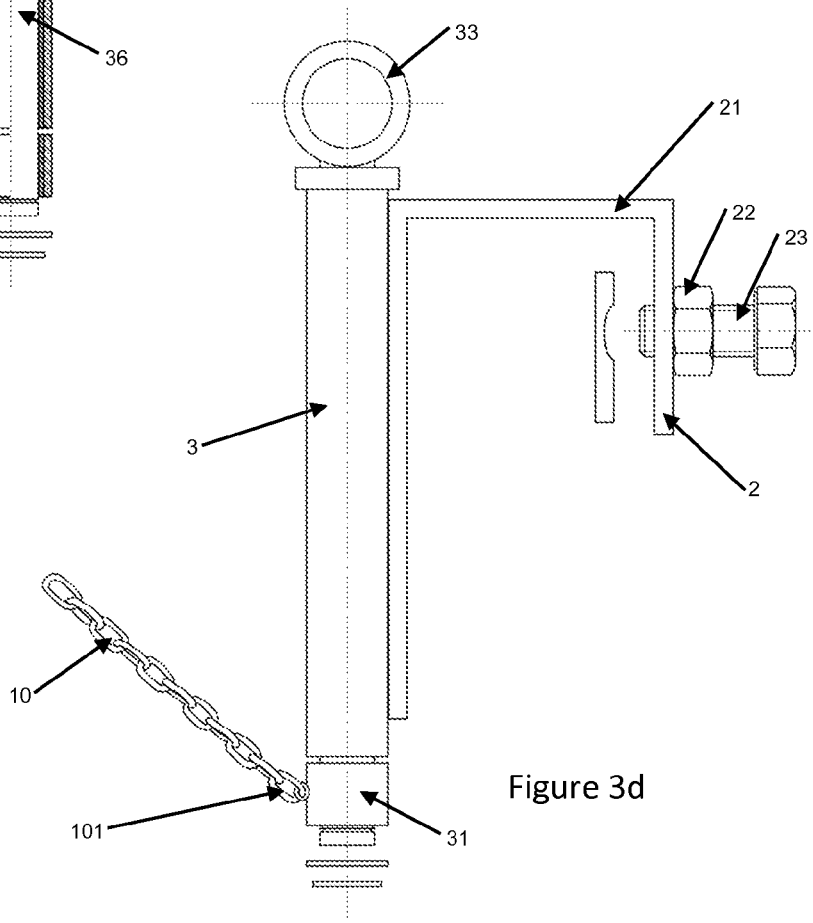
FIG. 3*d*, side view of the type T hinge of the present invention.
Figure 4A:
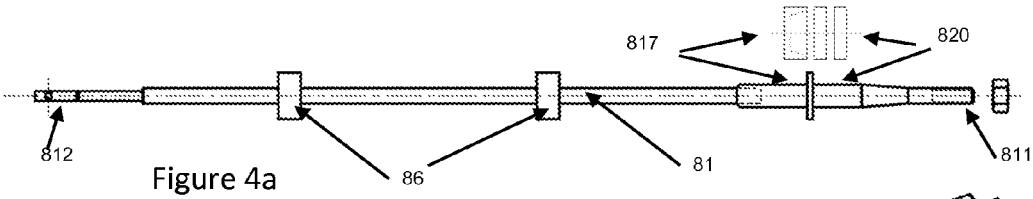
FIG. 4*a*: side view of the shaft of the transmission of the present invention.
Figure 4B:
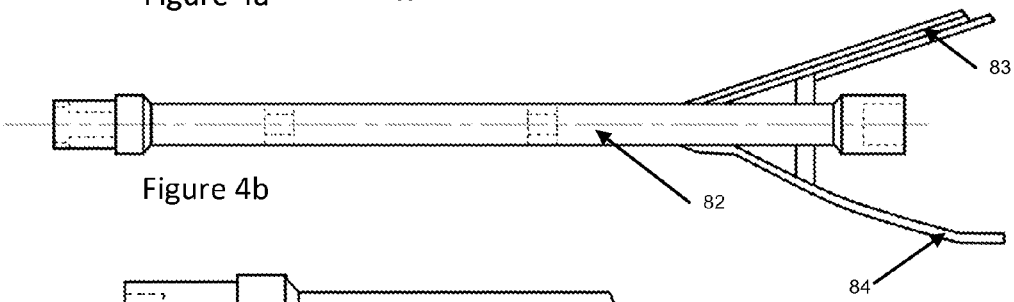
FIGS. 4*b* and 4*c*: side view and detail of the shaft holder of the transmission of the present invention.
Figure 4C:
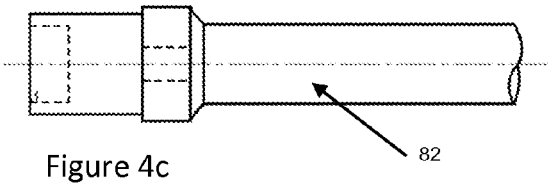
Figure 4D:
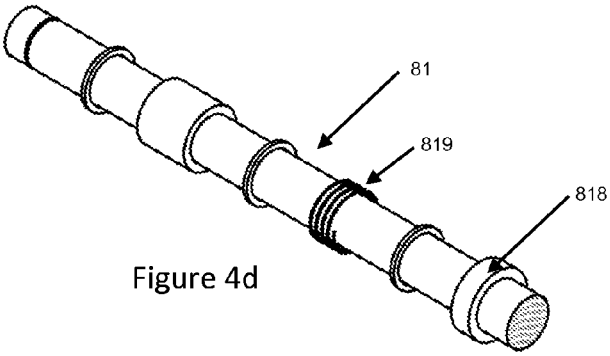
FIG. 4*d*: perspective view of the shaft and bearings of the transmission of this invention.
Figure 4E:
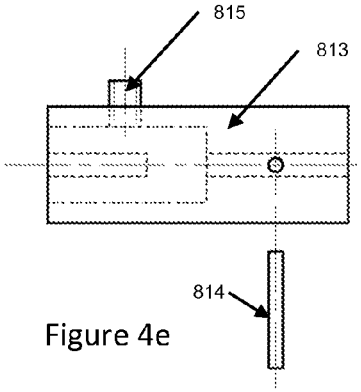
FIG. 4*e*: side view of a coupling element.
Figure 4F:
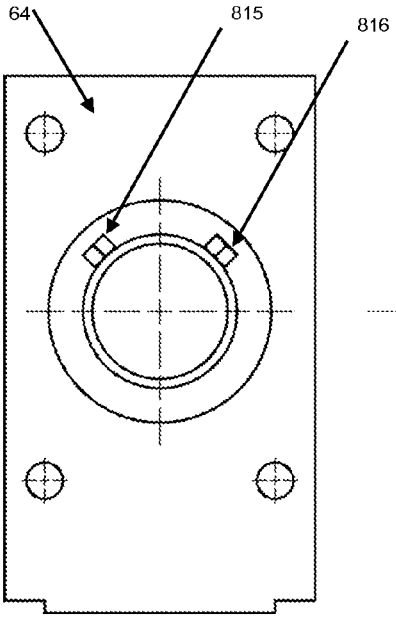
FIGS. 4*f* and 4*g*: bottom view and side view of a cylinder receiving the coupling element.
Figure 4G:
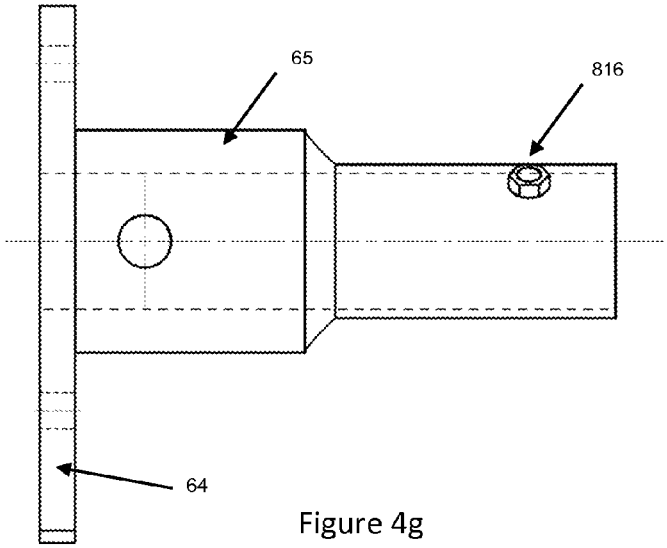
Figure 5A:
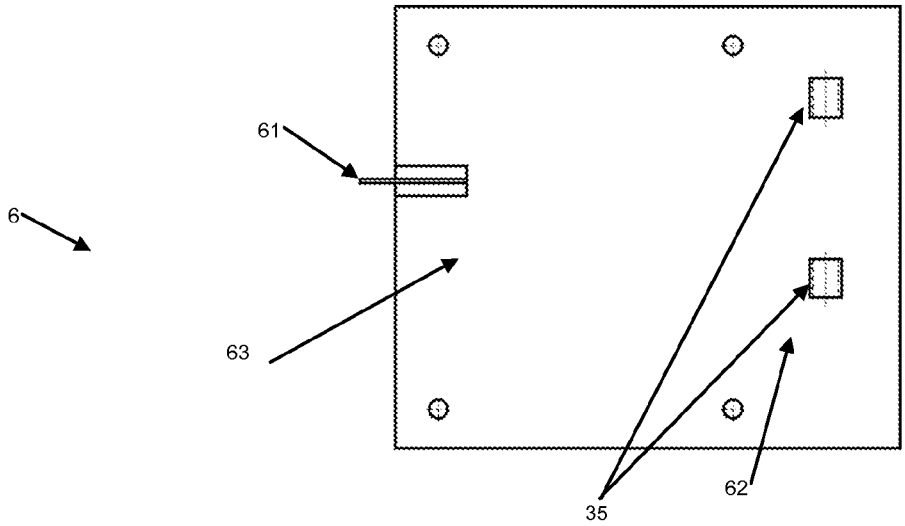
FIGS. 5*a* to 5*d*: Show the platform of the present invention in two side views an top and bottom views.
Figure 5D:
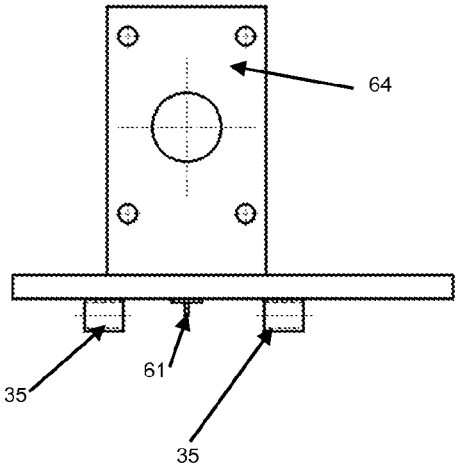
Figure 5B:
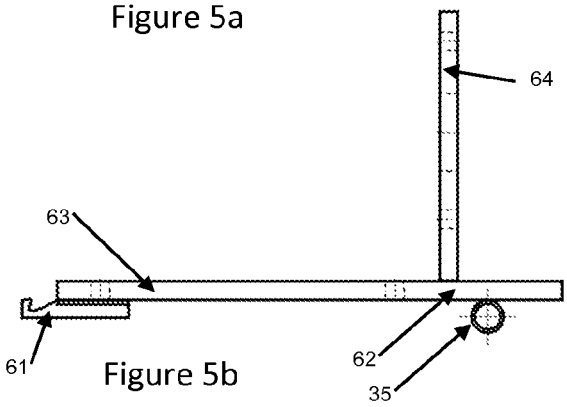
Figure 5C:
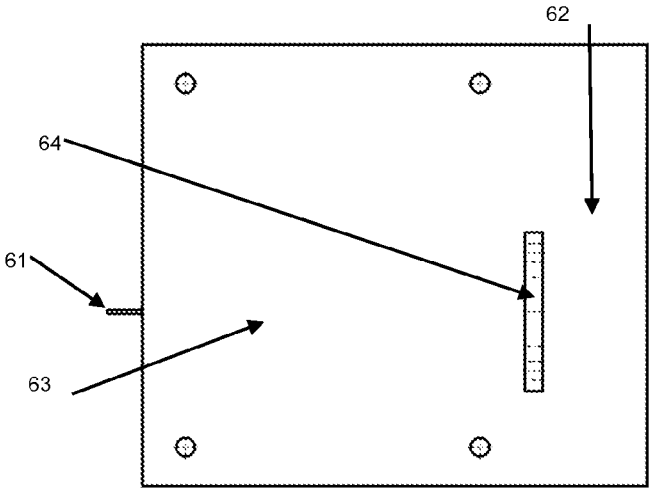
Figure 6:
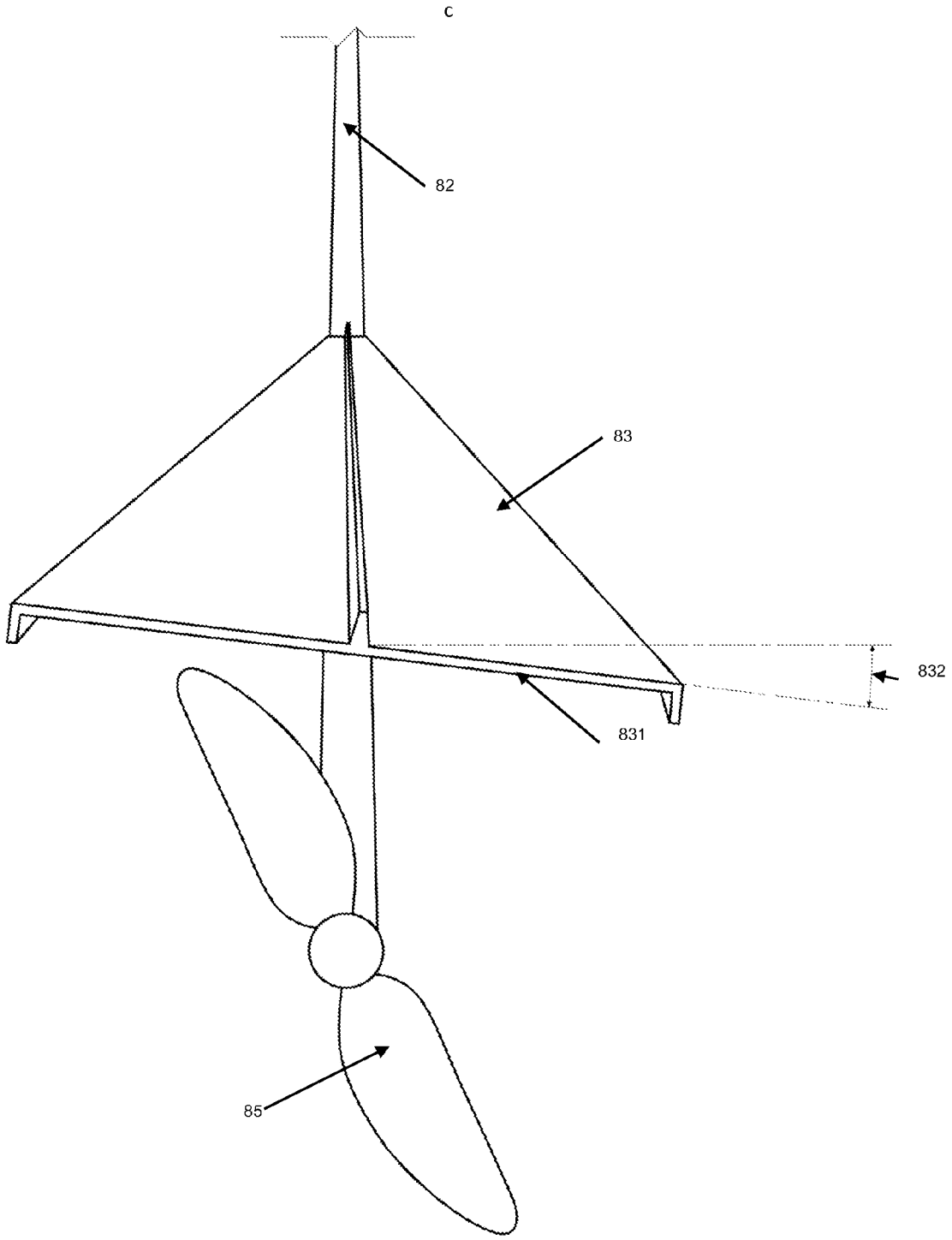
FIG. 6: Rear view of the transmission with the detailed view of the propeller and flap.

Vertical inclination angle: It refers to the angle at which the detachable boat propulsion device of the invention can be inclined upward and downward, as it can be seen in FIG. 1 (4)

Horizontal turn angle: It refers to the horizontal angle that the detachable boat propulsion device can sweep around the type T hinge. In this invention, the detachable boat propulsion device can turn 360° sexagesimals at this horizontal angle (5).

Trailing edge of the flap: It comprises the flap lower line located above the propeller or helix.

Adjustable clamp: It is a device which enables attaching the detachable boat propulsion device to the boat transom or a test bench. A preferred embodiment is a folded metal plate with bolts which tighten it to the boat.

Type T Hinge: It is defined as a hinge that comprises a hollow T tube. The upper part of the T carries a movable horizontal axis whose ends enter corresponding cylinders welded to said holder. This enables the holder to rotate freely in a vertical angle, upward and downward. A shaft inserted into the T main body is incorporated into a cylinder that rotates freely on the lower part of the T. Seguer-type locks can prevent these shafts from coming out of their housings as described.

Platform: It is an element supporting the motor and it is attached to the type T hinge, the transmission and the command handle. In a preferred embodiment, it is a metal plate base with holes to attach the command handle; it contains a fixation device which can be a welded hook in its command sector, and it also comprises another metal plate perpendicular to the first one, with holes to screw the motor on one side and a cylinder on the other side, to attach the transmission shaft holder.

Transmission sector: It is the rear part of the holder, on the transmission side, i.e., the side of the water where the propeller is submerged.

Command sector: It is the front part of the holder, on the side of the helmsman when the detachable boat propulsion device pushes the boat.

Motor: It can be any motor. It can be two-stroke or four-stroke engines. The latter are preferred for being non-pollutant engines. They can be from different manufacturers such as Yamaha, Honda, Villa, etc.

Transmission: It is defined as everything that is attached perpendicularly to the holder towards the water. This means: shaft, shaft holder, coupling system among the former, propeller, flap and deflector of foreign objects.

Shaft: It is defined as a metal shaft with means to be fixed to the shaft holder, such as bearings or roller-bearings. One of its ends is attached to the motor while the other is attached to the propeller.

Shaft holder: It is a hollow cylindrical part which can be a tube with means to be attached to the shaft, preferably by means of bearings or roller-bearings and at one of its ends to the perpendicular plate of the holder.

Flap: It is defined a part that is submerged into the water, tied to the shaft holder, above the propeller. Said flap may be of an almost triangular shape, being the side perpendicular to the shaft holder defined above as trailing edge.

Foreign bodies deflector: It is a metal device of an elongated shape, which is attached to said shaft holder and it is located under said propeller and also optionally on its sides.

Propeller: It is defined as the helix generating the thrust to propel the boat. Said helix may have a different number of blades (2, 3, 4, etc.) and different threads or inclines.

Bushing: It is a hollow cylinder which on its external side is attached to the internal side of the shaft holder, and its internal side is in contact with the shaft. It is preferably made of Teflon.

What is claimed is:

1. A detachable boat propulsion device, comprising:

a clamp adjustable to the boat;

a type T hinge on said clamp, which allows free rotation around a vertical angle and a horizontal angle of a platform attached to said T hinge;

said platform having attached thereto a command handle, a motor, and a transmission;

said transmission comprising: a shaft, a shaft holder, a flap, at least one deflector of foreign objects and a propeller;

wherein further comprising a flexible elongated element, which is tied at one end to said type T hinge and at the other end is hooked to a fixation device tied to said platform, and wherein said flexible elongated element limits freedom of rotation, when tensed, in said vertical inclination angle of said platform.

2. A detachable boat propulsion device according to claim 1 wherein said type T hinge comprises at its lower end a device that rotates freely according to its vertical axis and is securely attached to one of the ends of said flexible elongated element.

3. A detachable boat propulsion device according to claim 1 wherein said platform comprises a transmission sector on which said transmission is attached to above and said type T hinge is attached to below; and a command sector tied to said fixation device and reached by said command handle.

4. A detachable boat propulsion device according to claim 1 wherein said flexible elongated element may be attached to said fixation device in more than one position, allowing the user to vary the length of said flexible elongated element which is subject to traction and therefore to regulate said vertical inclination angle.

5. A detachable boat propulsion device according to claim 1 wherein said flexible elongated element is a chain and said fixation device is a hook which allows hooking any link of the chain.

6. A detachable boat propulsion device according to claim 1 wherein said flap comprises a trailing edge at an angle regarding the horizontal axis of between 1 and 10° sexagesimals.

7. A detachable boat propulsion device according to claim 1 wherein said flap comprises a trailing edge at an angle regarding the horizontal axis of between 1 and 5° sexagesimals.

8. A detachable boat propulsion device according to claim 1 wherein said transmission, between said shaft and said shaft holder, comprises at least two bushings which absorb shaft vibrations.

9. A detachable boat propulsion device according to claim 1 characterized by being disassembled and comprises said removable command handle which is affixed to the platform by screws; and said transmission is removable and it is attached to said platform by two set screws.

10. A detachable boat propulsion device according to claim 1 wherein said transmission comprising a conical roller-bearing which is fixed into position by means of a spring so that the axial strength of the shaft is not transferred to an engine crankshaft.

* * * * *